US010730694B2

(12) United States Patent
Goedken et al.

(10) Patent No.: US 10,730,694 B2
(45) Date of Patent: Aug. 4, 2020

(54) ZERO RADIUS AUTOMATED ARM

(71) Applicant: Kann Manufacturing Corporation, Guttenberg, IA (US)

(72) Inventors: Kenneth D. Goedken, Dubuque, IA (US); Jared Rowland, Dyersville, IA (US); Marlin Johnson, Guttenberg, IA (US); Roger Taake, Elkader, IA (US)

(73) Assignee: Kann Manufacturing Corporation, Guttenberg, IA (US)

( * ) Notice: Subject to any disclaimer, the term of this patent is extended or adjusted under 35 U.S.C. 154(b) by 0 days.

(21) Appl. No.: 15/486,952

(22) Filed: Apr. 13, 2017

(65) Prior Publication Data

US 2017/0297818 A1 Oct. 19, 2017

Related U.S. Application Data

(60) Provisional application No. 62/321,960, filed on Apr. 13, 2016.

(51) Int. Cl.

| | |
|---|---|
| ***B65F 3/00*** | (2006.01) |
| ***B65F 3/08*** | (2006.01) |
| *B65F 3/02* | (2006.01) |

(52) U.S. Cl.

CPC ..... *B65F 3/001* (2013.01); *B65F 3/08* (2013.01); *B65F 2003/023* (2013.01); *B65F 2003/0269* (2013.01); *B65F 2003/0276* (2013.01)

(58) Field of Classification Search

CPC ..... B65F 3/02; B65F 3/001; A61G 3/062
USPC ..... 414/408
See application file for complete search history.

(56) References Cited

U.S. PATENT DOCUMENTS

| | | | | |
|---|---|---|---|---|
| 5,222,853 A * | 6/1993 | Carson | B65F 1/004 | 414/408 |
| 5,702,225 A * | 12/1997 | Ghibaudo | B65F 3/08 | 414/408 |
| 6,474,928 B1 * | 11/2002 | Christenson | B65F 3/001 | 414/408 |
| 2006/0153667 A1 * | 7/2006 | Pruteanu | B65F 3/046 | 414/408 |

* cited by examiner

*Primary Examiner* — Saul Rodriguez
*Assistant Examiner* — Willie Bery, Jr.
(74) *Attorney, Agent, or Firm* — Shuttleworth & Ingersoll, PLC; Brett Papendick

(57) ABSTRACT

A collection mechanism for a side loading refuse collection vehicle that can move both horizontally and vertically to service multiple compartments designed for specific types of refuse or recyclables. A grabber assembly can move horizontally on a rail in either a lowered position or in a raised dumping position. The grabber assembly can move vertically on a mast. Preferably a sprocket wheel and a track are utilized to move the grabber assembly vertically from a street position to a dumping position.

8 Claims, 5 Drawing Sheets

ZERO RADIUS AUTOMATED ARM

CROSS-REFERENCE TO RELATED APPLICATIONS

The present application claims priority to provisional patent application 62/321,960 which was filed on Apr. 13, 2016, and is hereby expressly incorporated by reference in its entirety.

BACKGROUND

The present invention pertains to a zero radius automated arm for use with a refuse collection vehicle, namely a side loading commodity collection vehicle. Commodity (refuse or recycling) collection trucks come in three main types: front end loading, rear end loading, and side loading. In the case of side loading commodity collection bodies, certain collection bodies are separated into multiple compartments or hoppers into which different kinds of commodity may be loaded.

Collection of refuse commodities including organic and recyclable wastes requires efficient collection from commercial, industrial and manufacturing locations. In these environments numerous bins and containers are often used to accommodate large amounts of waste and recyclable material, and difficulties arise in efficiently emptying all the individual bins and containers into the commodity collection truck. Difficulties also arise in maneuvering bins and containers from certain locations due to space limitations.

The increased efforts to recycle and reuse components of the varied waste streams has created new challenges especially when dealing with dense urban environments, which include narrow streets and alleys, low overhanging utility lines, and tight access to loading docks.

Therefore, a commodity collection vehicle is needed that has multiple compartments for different types of refuse and recyclables while having a compact lifting mechanism.

BRIEF SUMMARY OF THE INVENTION

A collection mechanism allows horizontal movement in two planes of a grabbing mechanism which can then dump into a selected compartment of a collection vehicle after being vertically lifted and dumped. The grabbing mechanism can be moved between a forward and rearward positon so refuse bins or carts can be loaded into multiple independent compartments in a multi-compartment truck body, preferably a body having three compartments. The refuse bins can be loaded or dumped utilizing a vertical mast.

A zero radius grabbing mechanism dual motor, sprocket and rail system allows the vertical movement of the grabbing mechanism and the refuse bin up-and-down the mast. This has the benefits of easy maintenance, repair and replacement of wear components of the collection mechanism.

A three compartment body design can be utilized and is the first three compartment automated truck available to the refuse and recycling market. Particularly this three compartment unit could be used in the collection of food-scraps/organics along with one or two other commodities with no cross contamination between the collected commodities.

DETAILED DESCRIPTION OF THE INVENTION

Figure 1:
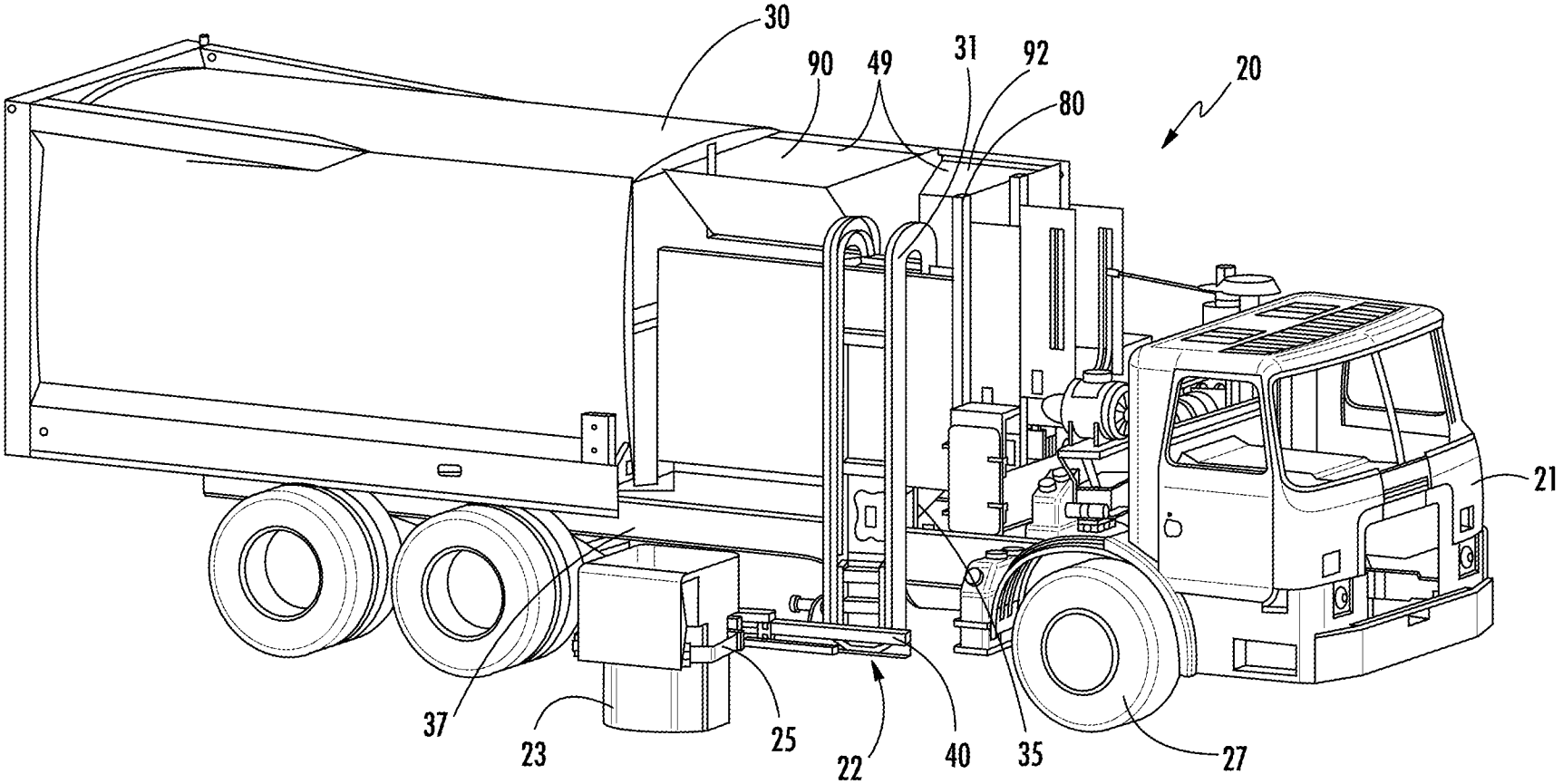
FIG. 1 is a perspective view of a refuse collection vehicle with a collection mechanism.
Figure 2:
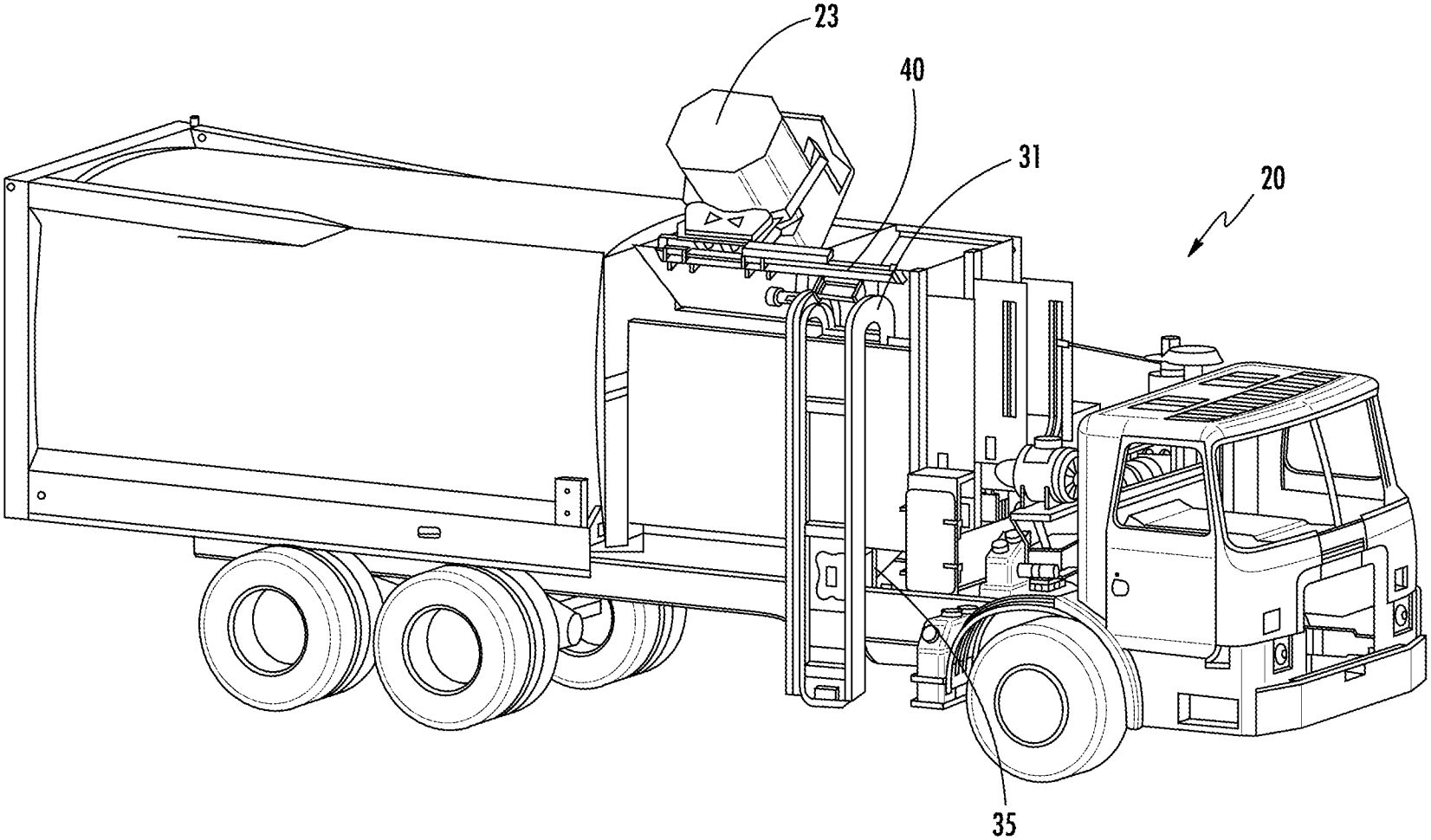
FIG. 2 is a perspective view similar to FIG. 1, except the refuse bin is in a raised position and being dumped into a first compartment of the refuse collection vehicle.
Figure 3:
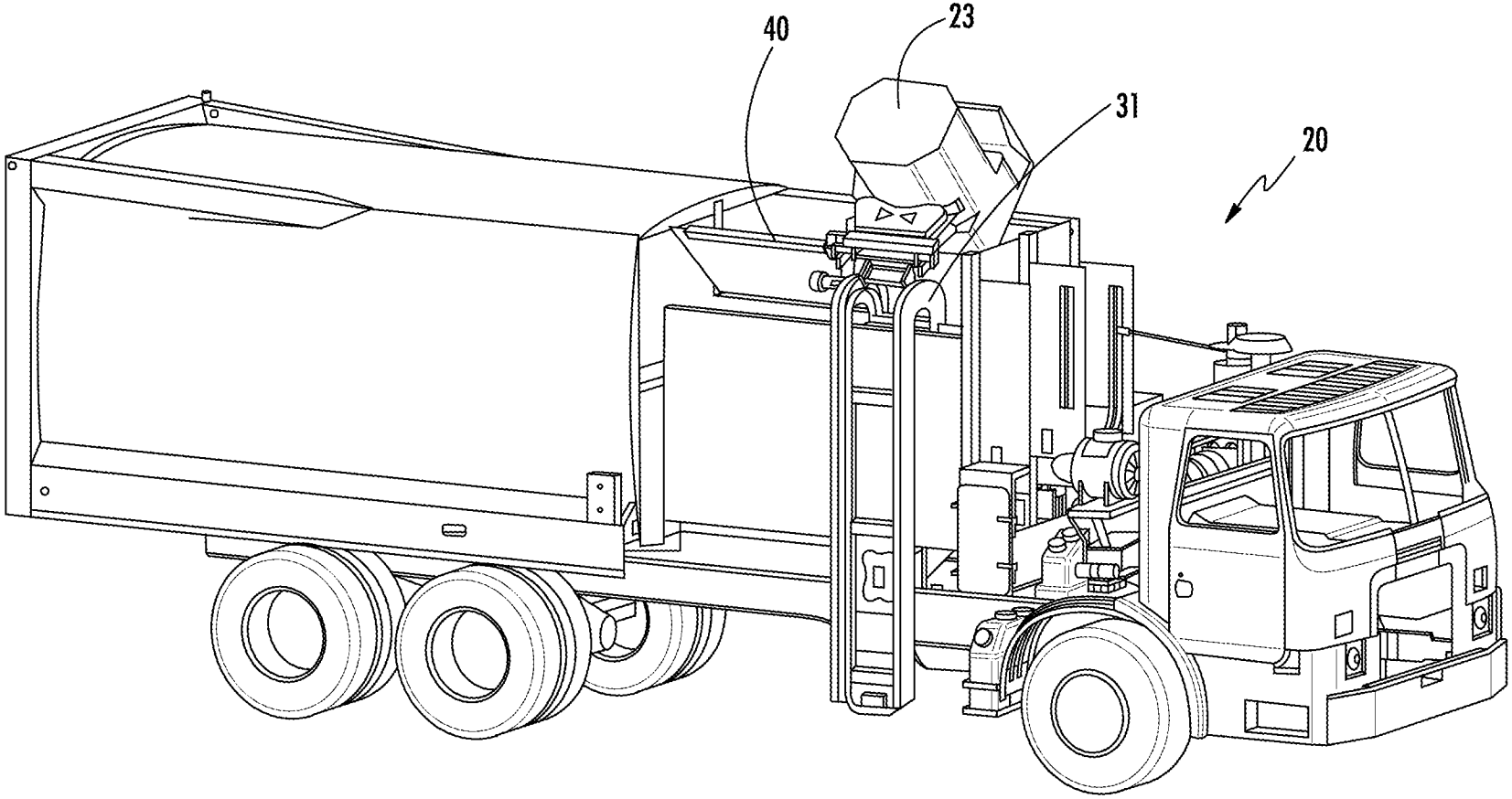
FIG. 3 is a perspective view similar to FIG. 2, except the refuse bin is being dumped into a different compartment.

Referring to FIGS. 1-3, a side loading refuse collection vehicle 20 having a collection mechanism 22 is shown. The refuse collection vehicle 20 has a cab 21 and the vehicle 20 is supported on wheels 27. The vehicle 20 includes a commodity collection body 30 with multiple compartments 49 that is carried on a chassis 37 of the vehicle 20. On a side of the vehicle 20, the collection mechanism 22 can be manipulated to engage a refuse bin 23 at street level.

The collection mechanism 22 comprises a grabber assembly 25, a rail 40, a linkage system 42, a mast 31, and a telescoping mechanism 35. The grabber assembly 25 has gripper arms 46 which are capable of grasping and securing the refuse bin 23. In operation, the grabber assembly 25 is extended away from the chassis 37 of the refuse collection vehicle 20 by utilizing the telescoping mechanism 35 and can be lowered as necessary by moving the grabber assembly up and down the mast 31 so that the grabber assembly 25 can grasp the refuse bin 23 around the upright sidewalls of the refuse bin 23. The grabber assembly 25 is then drawn back toward the chassis 37 of the refuse collection vehicle 20, again by utilizing the telescoping mechanism 35 in the opposite direction.

Figure 5:
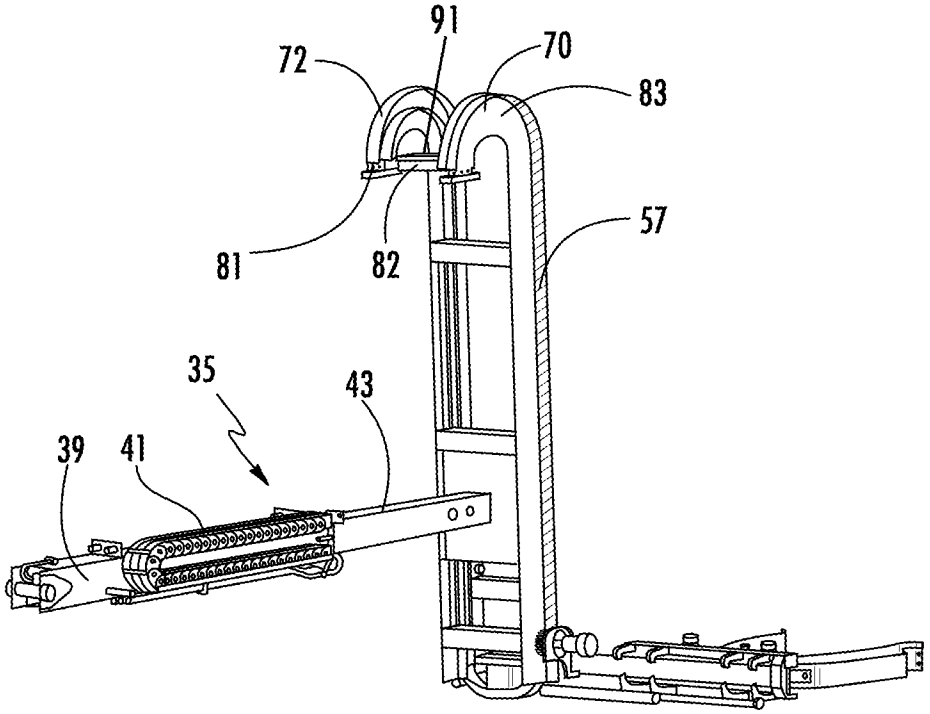
FIG. 5 is a perspective view from the rear of the grabbing assembly on the rail linked to the mast.
Figure 4:
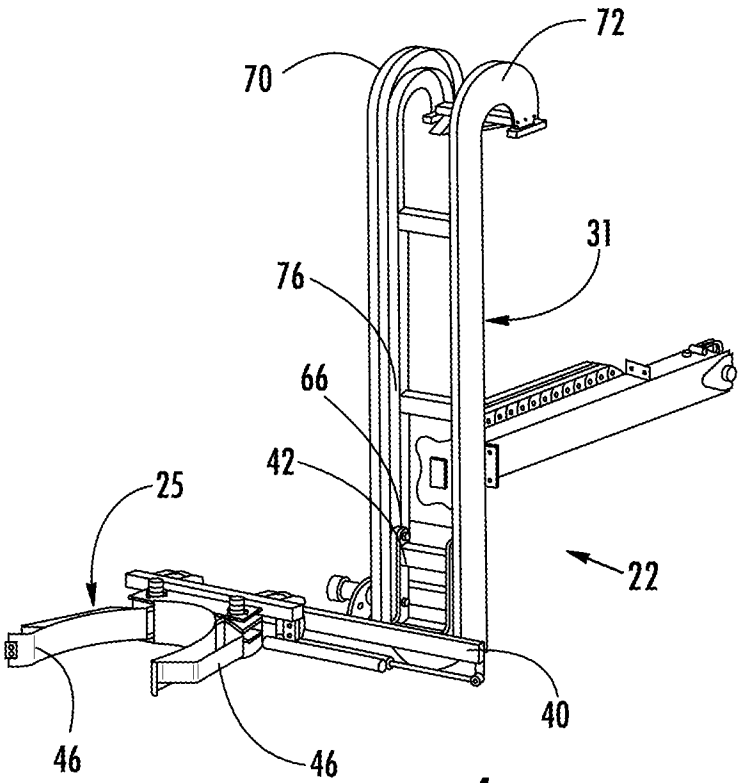
FIG. 4 is a perspective view from the front of a grabbing assembly on a rail linked to a mast.

As best seen in FIGS. 4 and 5, the telescoping mechanism 35 is shown in a non-extended position in FIG. 4 and an extended position in FIG. 4. The telescoping mechanism 35 comprises a fixed portion 39 with a belt 41 and a telescoping portion 43. If the refuse bin 23 is too far from the chassis 37 of the vehicle 20 such that the grabber assembly cannot reach the refuse bin 23, the belt 41 is activated by a motor and the telescoping portion 43 is extended outward away from the chassis 37. As the telescoping portion 43 is attached to the mast 31, the entire mast 31 along with the grabbing assembly 25 are extended outward as well. The process can be reversed once the refuse bin 23 has been secured.

Figure 6:
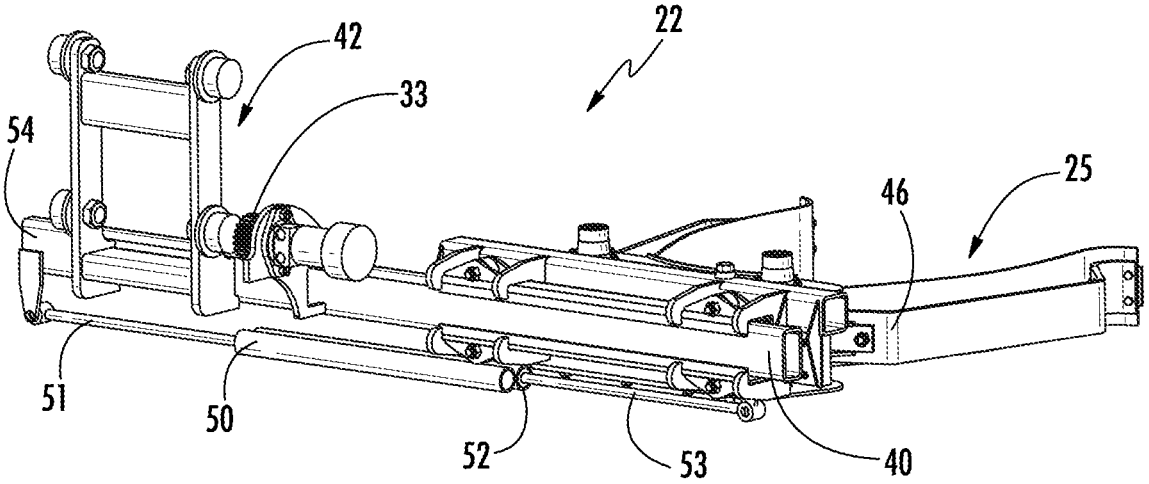
FIG. 6 is a perspective view from the front of the grabbing assembly on the rail.
Figure 7:
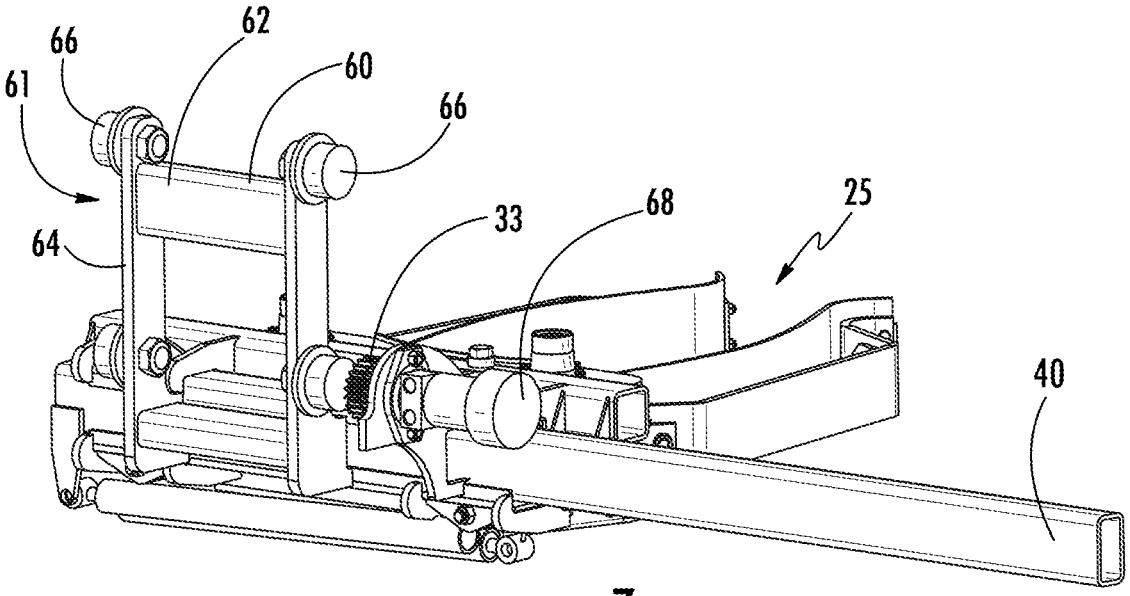
FIG. 7 is a perspective view from the back of the grabbing assembly on the rail.

As best seen in FIGS. 6 and 7, the grabber assembly 25 is selectively slidable on the rail 40 from a first position further away from the mast 31 to a second position nearest the mast 31. Additionally, the grabber assembly 25 can achieve a range of positions between the first position and the second position. The movement of the grabber assembly 25 between the first position and the second position is preferably accomplished by use of hydraulic cylinders 50 and 52 that contain rods 51 and 53 respectively. Hydraulic cylinder 50 is mounted to a first end 54 of the rail 40 while hydraulic cylinder 52 is mounted to the grabbing assembly 25.

The linkage system 42 includes a carriage 60 having a frame 61 comprising horizontal members 62 and vertical members 64. The frame 61 is mounted to the rail 40. Additionally, the carriage 60 includes cam follower rollers 66 attached to the frame 61. The linkage system includes a sprocket wheel 33 and a motor 68 that can rotate the sprocket wheel 33 both clockwise and counterclockwise.

The mast 31 comprises a first frame member 70 and a second frame member 72 that span vertically from the rail 40 to a top 80 of the vehicle 20. Each frame member 70 and 72 include a channel 76 in which the cam follower rollers 66 are held. The frame members 70 and 72 are mounted to the telescoping portion 43 of the telescoping mechanism 35. At least one of the frame members 70 and 72 has a track 57.

Now referring additionally to FIGS. 1, 2, and 3 the refuse bin 23 is shown in different positions. FIG. 1 shows the refuse bin 23 in an initial position at ground level in which the bin 23 is secured by the grabber assembly 25. As shown in FIG. 2, the motor 68 can be activated which rotates the sprocket wheel 33 in a first direction which causes the sprocket wheel 33 to climb the track 57 incrementally. As the sprocket wheel 33 is indirectly attached to the rail 40, and the rail 40 attaches to the grabber assembly 25 and the carriage 60, the rail 40, the grabber assembly 25 and the carriage 60 all move upward in a vertical movement. These components move upward and are guided by the channels 76 in the "candy cane" shaped first frame member and the second frame member 72. The cam follower rollers 66 follow the channels 76 until they reach an end 81. As the components go over the "U-shaped" portion 83, the refuse bin 23 is inverted and the contents are dumped into a first compartment 90 of the vehicle 20. Stops 82 halt the movement of the carriage 60, while wear pads 91 increase the longevity of the carriage 60 and reduce forces on other components of the system.

As best seen in FIG. 3, the refuse bin 23 is being dumped in a second compartment 92 of the vehicle 20. Although the vertical movement up the mast 31 occurs in the same manner, the grabber assembly 25 is in the second position due to the actuation of the rods 51 and 53 associated with the hydraulic cylinders 50 and 52 as described previously above. The reverse procedure takes place to put the refuse bin 23 back at the curb.

The overall collection mechanism 22 allows horizontal movement in two planes that are substantially perpendicular to one another, while also allowing vertical movement. The compact design and zero radius aspect allow the collection mechanism to work in tight spaces. The telescoping mechanism 35 is housed under the compartments of the vehicle 20 and can maintain the mast 31 in a position close to the vehicle when the telescoping portion is in the non-extended position.

Having thus described the invention in connection with the preferred embodiments thereof, it will be evident to those skilled in the art that various revisions can be made to the preferred embodiments described herein with out departing from the spirit and scope of the invention. It is my intention, however, that all such revisions and modifications that are evident to those skilled in the art will be included with in the scope of the following claims.

The invention claimed is:

1. A collection mechanism for a refuse collection vehicle having a first compartment and a second compartment, comprising:

a grabber assembly configured to selectively secure a refuse bin;

a horizontal rail;

the grabber assembly movable on the horizontal rail;

a mast;

the mast having a first end and a second end;

the first end to the second end comprising an entirety of the mast;

a telescoping member;

the entirety of the mast movable outwardly in a horizontal direction from the refuse collection vehicle by the telescoping member;

wherein the first end moves a substantially same distance in the horizontal direction as the second end when the entirety of the mast moves outwardly in the horizontal direction from the refuse collection vehicle;

the grabber assembly movable vertically on the mast;

a motor configured to move the grabber assembly;

the grabber assembly can be moved from a first position to a second position;

the first position aligns with the first compartment of the refuse collection vehicle;

the second position aligns with the second compartment of the refuse collection vehicle;

the mast has a track;

a linkage system that connects the grabber assembly to the mast;

the linkage system has a sprocket wheel that can move along the track.

2. The collection mechanism of claim 1, wherein:

the horizontal movement of the grabber assembly and the vertical movement of the grabber assembly are independent of one another.

3. The collection mechanism of claim 2, wherein:

a first hydraulic cylinder moves the grabber assembly from the first position to the second position.

4. The collection mechanism of claim 3, wherein:

a second hydraulic cylinder is utilized to move the grabber assembly in a horizontal plane at a greater distance than if only the first hydraulic cylinder was used.

5. A refuse collection vehicle having multiple compartments, comprising:

a cab;

a collection body supported on a chasis;

a collection mechanism on a side of the vehicle;

the collection mechanism comprising a grabber assembly;

the collection mechanism further comprising a mast and a rail;

the grabber assembly movable horizontally on the rail;

the grabber assembly movable vertically on the mast;

the collection body has a first compartment and a second compartment;

the grabber assembly can be moved from a first position to a second position;

the first position aligns with the first compartment of the refuse collection vehicle;

the mast having a first end and a second end;

the first end to the second end comprising an entirety of the mast;

a telescoping member;

the entirety of the mast movable outwardly in a horizontal direction from the refuse collection vehicle by the telescoping member;

wherein the first end moves a substantially same distance in the horizontal direction as the second end when the entirety of the mast moves outwardly in the horizontal direction from the refuse collection vehicle;

the grabber assembly can be moved from a first position to a second position;

the first position aligns with the first compartment of the refuse collection vehicle;

the second position aligns with the second compartment of the refuse collection vehicle;

the mast has a track;

a linkage system that connects the grabber assembly to the mast;

the linkage system has a sprocket wheel that can move along the track.

6. The refuse collection vehicle of claim 5, wherein:

the horizontal, movement of the grabber assembly and the vertical movement of the grabber assembly are independent of one another.

7. The refuse collection vehicle of claim 6, wherein:

first hydraulic cylinder moves the grabber assembly from the first position to the second position.

8. The refuse collection vehicle of claim 7, wherein:

a second hydraulic cylinder is utilized to move the grabber assembly in a horizontal plane at a greater distance than if only the first hydraulic cylinder was used.

* * * * *